US010118085B2

(12) United States Patent
Schleuniger

(10) Patent No.: US 10,118,085 B2
(45) Date of Patent: Nov. 6, 2018

(54) ICE RINK ILLUMINATION

(71) Applicant: HS TECHNICS AG, Dietikon (CH)

(72) Inventor: Roman Schleuniger, Urdorf (CH)

(73) Assignee: HS TECHNICS AG, Dietikon (CH)

( * ) Notice: Subject to any disclaimer, the term of this patent is extended or adjusted under 35 U.S.C. 154(b) by 0 days.

(21) Appl. No.: 15/527,472

(22) PCT Filed: Nov. 25, 2015

(86) PCT No.: PCT/CH2015/000170
§ 371 (c)(1),
(2) Date: May 17, 2017

(87) PCT Pub. No.: WO2016/082048
PCT Pub. Date: Jun. 2, 2016

(65) Prior Publication Data

US 2017/0326435 A1 Nov. 16, 2017

(30) Foreign Application Priority Data

Nov. 26, 2014 (CH) ..... 1824/14

(51) Int. Cl.
*A63C 19/10* (2006.01)
*F21V 31/00* (2006.01)
(Continued)

(52) U.S. Cl.
CPC ..... *A63C 19/10* (2013.01); *F21V 3/062* (2018.02); *F21V 23/003* (2013.01); *F21V 23/06* (2013.01);
(Continued)

(58) Field of Classification Search
CPC ..... A63C 19/00; A63C 19/10; E01C 13/00; E01C 13/105; F21Y 2115/10;
(Continued)

(56) References Cited

U.S. PATENT DOCUMENTS 2,587,855 A 3/1952 Johnson
3,755,663 A * 8/1973 George, Jr. ..... G09F 13/28 313/317
(Continued)

FOREIGN PATENT DOCUMENTS

JP 2001-243818 9/2001
JP 2004-281280 10/2004
(Continued)

OTHER PUBLICATIONS

English translation of International Preliminary Report on Patentability dated May 30, 2017 (May 30, 2017), Application No. PCT/CH2015/000170, 8 pages.

*Primary Examiner* — Kien Nguyen
(74) *Attorney, Agent, or Firm* — Rankin, Hill & Clark LLP

(57) ABSTRACT

The illuminants arrangement includes a plurality of LED-based light sources that are encased in a water-tight manner by way of one or more encasings, wherein the light sources are, at least in a group-wise manner, operationally interconnected by way of electrical connection leads. The connection leads include voltage supply leads. The illuminants arrangement as a protection of the one or more encasings and the light sources from mechanical damage includes at least one protective overlay for being placed onto the one or more encasings, so that light emitted by the light sources can be emitted through the at least one protective overlay. The illuminants arrangement can include a heating device. Each of the light sources can be suitable for emitting light of a variable color, wherein the color of each of the light sources can be individually selected by way of a control unit.

29 Claims, 3 Drawing Sheets

(51) Int. Cl.

| | |
|---|---|
| ***F21V 23/06*** | (2006.01) |
| ***F21V 29/90*** | (2015.01) |
| ***F21V 23/00*** | (2015.01) |
| ***F21V 3/06*** | (2018.01) |
| *E01C 13/00* | (2006.01) |
| *F21Y 115/10* | (2016.01) |
| *F21Y 105/10* | (2016.01) |
| *F21Y 103/10* | (2016.01) |
| *F21Y 113/13* | (2016.01) |

(52) U.S. Cl.
CPC ..... *F21V 29/90* (2015.01); *F21V 31/00* (2013.01); *A63C 2203/14* (2013.01); *F21Y 2103/10* (2016.08); *F21Y 2105/10* (2016.08); *F21Y 2113/13* (2016.08); *F21Y 2115/10* (2016.08)

(58) Field of Classification Search
CPC ..... F21Y 2113/13; F21Y 2105/00; F21Y 2105/10; F21V 33/00
USPC ..... 472/88–92; 362/253; 62/66
See application file for complete search history.

(56) References Cited

U.S. PATENT DOCUMENTS

| | | | | |
|---|---|---|---|---|
| 4,551,985 | A * | 11/1985 | Kovach | E01C 13/105 126/561 |
| 7,549,784 | B1 * | 6/2009 | Teeters | F21V 23/06 362/145 |
| 8,833,971 | B2 * | 9/2014 | Todd | A63C 19/10 313/504 |

FOREIGN PATENT DOCUMENTS

| | | |
|---|---|---|
| KR | 10-1026669 | 4/2011 |
| WO | 2009/036003 | 3/2009 |
| WO | 2011/046961 | 4/2011 |

* cited by examiner

ICE RINK ILLUMINATION

BACKGROUND OF THE INVENTION

Field of the Invention

The invention on the one hand relates to the field of illumination technology and on the other hand to ice rinks, in particular ice rinks which form playing fields, in particular for ice hockey sports.

Description of Related Art

The possibility of illumination tubes being able to be frozen into ice slabs, so as to permit monochromic light lines to appear in the ice, is known, for example, for disco events.

It is also known to project advertising banners onto the surface of the ice of the ice rink by way of projectors attached above the ice rink, during pauses or breaks in ice hockey matches.

Moreover, it is known to realise playing field markings in the form of felt strips that are incorporated into an ice rink.

SUMMARY OF THE INVENTION

The inventor has recognised that a melting of commercially available illuminants arrangements into ice rinks does not lead to satisfactory results in many applications, in particular in the profession field such as, for example, in the field of ice hockey.

The inventor has further recognised new applications for illumination devices in ice rinks.

It is an object of the invention to realise an illumination for ice rinks, which is sufficiently robust, so as to be able to be used in ice hockey playing fields or similar professionally operated ice rinks.

In particular, on the one hand, an illuminants arrangement that can be repeatedly brought into an ice rink, frozen therein and removed from this again can be provided. And, on the other hand, an illuminants arrangement that is designed to remain in the ice rink over the longer term can also be created.

A further object of the invention is to provide an illuminants arrangement that can also withstand high mechanical loads as can occur for example in ice hockey matches, without becoming damaged or which is at least capable of withstanding such loads to the extent that the encased light sources of the illuminants arrangement as well as their encasing remain undamaged by such loads.

A further object of the invention is to provide ice rinks with illumination devices that permit the representation of two-dimensional graphics and/or moved (two-dimensional pictures).

A further object of the invention is to simplify the removal of an illuminants arrangement that has been introduced into an ice rink, out of the ice rink.

A further object of the invention is to create new types of illuminants arrangements, in particular wherein these are of such a nature that their incorporation into an ice rink and/or removal from the ice rink is simplified.

A further object of the invention is to provide an illumination device that is suitable for incorporation into an ice rink and whose emission of light can be effectively controlled.

A further object of the invention is to provide an ice rink, in particular an ice hockey playing field which includes playing field markings (lines, playing field lines) which are realised in a new manner; in particular wherein common paying field markings (such as e.g. coloured felt strips incorporated into the ice) are replaced and thus become obsolete.

A further object of the invention is to provide an improved method for incorporating an illuminants arrangement into an ice rink.

A further object of the invention is to provide an ice rink inlay which can simplify an incorporation of an illuminants arrangement into an ice rink.

A further object of the invention is to provide a replacement for conventional cover layers, which are typically based on white chalk powder.

A further object of the invention is to provide an illuminants arrangement that has an inconspicuous appearance when it is incorporated into an ice rink, as well as a corresponding ice rink.

A further object of the invention is to provide corresponding illuminants arrangements and/or illumination devices and/or ice rink inlays and/or ice rinks and/or methods. At least one of these objects is achieved at least partly by way of devices and methods according to the patent claims.

The illuminants arrangement includes a multitude of light sources that are based on LEDs and that are encased in a water-tight manner by way of one or more encasings, wherein the light sources are, at least in a group-wise manner, operationally interconnected by way of electrical connection leads. The connection leads typically include voltage supply leads. The illuminants arrangement includes at least one protective overlay as a protection of the light sources from mechanical damage, wherein light emitted by the light sources can be emitted through the at least one protective overlay.

In particular, the protective overlay can be present additionally to the one or more encasings. Thereby, the protective overlay can be envisaged for being brought onto the one or more encasings, so that light emitted by the light sources can be emitted through the at least one protective overlay.

The protective overlay can serve as a protection of the one or more encasings from mechanical damage.

The protective overlay can be of several parts.

The protective overlay can be fastened to further parts of the illuminants arrangement, which include the light sources. Or it can lie on these, in particular on the one or more encasings.

Sensitive parts of the illuminants arrangement, such as the light sources and possibly also the (possibly the flexible, elastic) encasing are protected from damage by the protective overlay, which can be occasionally exchanged if need be, wherein such damage can be caused, for example, by a stripping away of an (upper) part of the ice rink and/or by the ice skate blades and/or ice hockey sticks penetrating into the ice of the ice rink.

The protective overlay in particular can be breakage-resistant.

It can be cut-resistant, in particular more cut-resistant than the one or more encasings.

It can be hard, in particular harder than the one or more encasings.

The protective overlay can be manufactured of a transparent material, in particular of a transparent plastic, at least for the most part. In particular, the plastic can be colourless.

However, it can also be of a non-transparent (preferably then white) material, with holes for the passage of light.

The protective overlay can also be non-transparent (e.g. white) with transparent regions for the passage of light.

The protective overlay can be plate-like. Thereby, the plate shape can also be elongate, so that the protective overlay is then rod-like.

However, it can also have a U-shaped profile that encompasses at least another part of the illuminants arrangement at three sides.

The protective overlay can include fasteners for fastening the protective overlay onto at least one other part of the illuminants arrangement.

In an embodiment, the protective overlay—at least for the most part—is manufactured from a polycarbonate.

In another embodiment, the protective overlay—at least for the most part—is manufactured of a silicone.

The encasing or a part of this—at least for the most part—can be formed for example by a polyurethane.

The encasing can be formed, for example, by way of moulding (potting) the light source(s) into a potting mass, e.g. into a polyurethane.

In an embodiment, the illuminants arrangement includes at least one strip-shaped unit with a rectangular cross section, wherein the three sides of the respective strip are formed by a non-transparent plastic, and wherein the volume between the three sides includes at least one of the light sources (typically several) as well as a potting mass, e.g. polyurethane, in which the at least one light source is potted. Such illuminants arrangements for monochromatic operation are commercially available, for example under the name "aqualuc" (www.aqualuc.de).

In other embodiments, the illuminants arrangement, however, can include at least one strip-shaped unit with a non-rectangular cross section, for example with a round cross section.

The LEDs can be conventional LEDs or also other LEDs such as OLEDs (organic light emitting diode).

Special LED arrangements can be applied, e.g. as are known from LED filament lamps, obtainable, for example, under the description LCC (laser crystal ceramics).

The LEDs can be voltage-controlled LEDs or also current-controlled LEDs.

A dimming of the LED or a control of the intensity of the light emitted by the LED can be effected by way of, for example, rectangular signals with a variable duty cycle (pulse-width modulation).

In an embodiment, each of the light sources has no more than a single LED (light emitting diode). This can be provided for example for the emission of white light. A greater flexibility of the illuminants arrangement however results if each of the light sources includes several LEDs, in particular three (e.g. an LED emitting red light, one emitting green light and one emitting blue light) or four (e.g. an LED emitting red light, one emitting green light, one emitting blue light and one emitting white light). Five LEDs can also be provided, wherein e.g. an LED emitting red light, one emitting green light, one emitting blue light and two emitting white light can then be provided, wherein the two LEDs emitting white light typically emit white light of a different colour temperature, e.g. one of a warm white (e.g. between 2500 K and 3200 K colour temperature) and one of a cold white (e.g. between 5000 K and 7000 K colour temperature). In the case that each of the light sources include only two LEDs, then these for example can emit white light of a different colour temperature, e.g. as specified beforehand.

Many new types of possible applications result from this, particularly if each of the light sources is individually controllable.

In an embodiment, each of the light sources is suitable for the emission of light of a variable colour and/or variable intensity.

One can envisage the electrical connection leads for a control of the multitude of light sources being designed by way of a bus. Thereby, at least one electrical circuit can be assigned to each of the multitude of light sources, said electrical circuit being designed for a control of the assigned light source according to digital control data transmitted via the bus.

An efficient control of the light emission can be achieved in such a manner. For example, a control can be effected according to the DMX512 Standard known from illumination technology. Alternatively, a control according to the DALI standard (digital addressable lighting interface) or according to KNX-standard can be used.

One can envisage each of the light sources being able to be individually activated and a colour and a light intensity being able to be individually set for each of the light sources, by way of the control. This e.g. can be particularly useful if static or moving pictures are to be represented Alternatively or additionally, one can envisage there being one or more groups of light sources which each include several light sources, wherein the light sources of each group each obtain the same control signal. A representation of playing field markings such as circles or boundary lines can therefore be realised in a simple way and manner.

The voltage supply leads can be provided additionally to the connection leads for the bus.

It can be particularly efficient if the connection leads for the bus simultaneously serve as voltage supply leads for the light sources.

In an embodiment, the illuminants arrangement includes a heating device for producing heat. This is not identical to the light sources, thus is present in addition to the light sources.

In an embodiment, the illuminants arrangement includes at least one strip-shaped unit including a plurality of LED-based light sources that are arranged successively along a strip described by the strip-shaped unit, wherein the strip-shaped unit includes a heating device for producing heat. In particular, the heating device can include one or more heating wires for the production of heat. Ice surrounding the strip-shaped unit can be melted by way of the heat produced by way of this. This can simplify a removal of the illuminants arrangement from the ice rink.

An electrical current can flow through the heating wire or the heating wires for producing the heat.

An electrical insulation can be provided around the heating wire or wires, for example a cable sheath.

In a typical embodiment, the heating device is present additionally to the light sources.

The mentioned plurality of LED-based light sources in particular can be encased in a water-tight manner by a common encasing.

A heating wire can be provided to the left and a heating wire to the right, of the upwardly emitting light sources, in particular along the strip.

In an embodiment, the strip-shaped unit includes a thermally conductive rail which extends along the strip and which is in thermal contact with the one or more heating wires. In particular, at least one outer surface of the strip-shaped unit, in particular three, can be formed by the rail.

The rail can be a metal rail, for example an aluminium rail.

The rail can include a receiving opening for the strip-shaped unit.

The rail at the outside can laterally (thus at the left and right) each include a groove for receiving one of the heating wires.

An embodiment, in which the light sources are arranged distributed over a surface, typically in the manner of grid points of a grid is of particular interest.

Particularly varied and new applications are rendered possible together with the already mentioned possibility of individually controlling each of the light sources and in particular furthermore for the case in which each of the light sources can emit light of variable brightness and colour (and is controlled accordingly).

The ice rink, for example, or a part of this can be used, for example, as a film monitor and/or for showing advertising. Playing field regions, e.g. playing field lines can be highlighted temporarily and/or also in an animated manner or displayed in a special manner.

In an embodiment, the illuminants arrangement includes first connecting elements for stabilising a relative positioning of the light sources to one another in a first direction parallel to the surface, as well as second connecting elements for stabilising a relative positioning of the light sources to one another in a second direction which is different than the first direction (in particular perpendicular to the first direction) and is parallel to the surface.

Thereby, the first or the second or also the first and the second connecting elements can serve for a stabilisation of a relative position of the light sources to one another in a direction perpendicular to the surface.

An incorporation of the illuminants arrangement into the ice rink is simplified by way of the mentioned connecting elements, in particular inasmuch as a sufficiently accurate relative positioning of the light sources of the illuminants arrangement is simplified.

The illuminants arrangement can be water-permeable.

The illuminants arrangement with the mentioned connecting elements can be structured, for example, such that open regions in the surface exist between at least some of the connecting elements, or that open regions are formed in the surface by at least some of the connecting elements, wherein the open regions can be filled with water in the case of introducing an illuminants arrangement into the ice rink.

In this manner, one prevents the illuminants arrangement from including the creation of a high-quality ice rink. For example, by way of this one can prevent the illuminants arrangement from forming an intermediate layer in the ice rink over the whole surface. If such a mentioned surface were to be continuously taken up by the illuminants arrangement, then the quality of the ice and/or the hardness of the ice could be reduced, and fractures in the ice rink could be encouraged and/or the transfer of cold up to the surface of the ice could be prevented.

In an embodiment, the first connecting elements are at least partly formed by the encasing.

The illuminants arrangement can include, for example, several illumination strips (strip-shaped units) which are arranged in parallel to one another and which are manufactured in the manner of the commercially available "Aqualuc" products, which are mentioned above, wherein however provisions are to be made for the individual control of the light sources, and wherein adjacent illumination strips are each connected to one another at several locations (by way of the mentioned second connecting elements).

In a further embodiment, the first connecting elements are formed at least party by the connection leads.

The second connecting elements can be formed, for example, by transverse struts.

In an embodiment, the illuminants arrangement includes a multitude of optical lenses, in particular lenses for focussing light which has been emitted by the light sources. In particular, the light sources can be arranged below the optical lenses. An optical lens for example can be assigned to each of the light sources.

In some embodiments, each of the light sources is fixedly connected to an optical lens that is assigned to it. E.g., integrated components, which each include a light source and an optical lens belonging to the light source, can be provided.

In an embodiment, the optical lenses are integrated in the at least one protective overlay. However, they can also be provided additionally to this, e.g. they can each be arranged between one or more of the light sources and a protective overlay.

The light flux can be controlled by way of the optical lenses, for example by way of a focussing of the light emitted by the light sources being effected in a direction perpendicular to the surface of the ice by way of the optical lenses.

The ice rink inlay includes an illuminants arrangement, e.g., an illuminants arrangement described in the present patent application, as well as a layer body. A cover layer of the ice rink can be formed by the layer body. Accordingly, the layer body can have a white surface.

Accordingly, the layer body (at least in sections) can form a white cover layer in the ice of an ice rink.

The layer body can form a layer, on account of which one can do without a cover layer known from the state of the art, as is created, e.g., based on chalk.

The illuminants arrangement can be fastened on the layer body, in particle mechanically fastened thereto, e.g. by way of a suitable shaping (of the layer body and/or of the illuminants arrangement) and/or by way of suitable fastening elements such as clips or pins. The mentioned shaping or the mentioned fastening elements can also serve for example as positioning aids.

The layer body can be water-permeable. It can be well integrated into an ice layer in this manner.

The water permeability can be achieved by way of the structure of the layer body and/or by its material characteristics. E.g., the layer body can include a multitude of holes which go through it, such as, for example, in the case of a holed or perorated foil. The layer body can be fibrous, such as e.g. a felt, and it can also include felt. The layer body can include a woven material or even be a woven material, e.g. a glass fibre woven material and include holes on account of this.

The layer body in particular can be formed by a porous material.

The layer body can be self-supporting, in contrast to the known cover layers that are based on chalk powder and are accordingly not self-supporting (at least before incorporating into the ice rink), due to then being fluid or powdery on being introduced into the ice rink. Textile rolls or felt rolls and also foils or plates that make up the layer body or belong to this are self-supporting.

In some embodiments, the layer body includes several sections that can be joined together for forming the layer body.

In some embodiments, the layer body includes several shape-stable plates. The shape stability does not exclude an elastic flexibility. The plates can be movable relative to one another. Thereby, they can be (partly) continuous, for example each can be connected at an edge or a side to a further plate. In this case, they can be folded onto one another for example, e.g. in the manner of a Leporello (i.e., accordion). Or the plates can also be separate plates that can then be stacked upon one another.

The plates can also be joined together, e.g. stuck together (for forming a larger surface).

The layer body can also include shape-stable plates.

The layer body is also flexibly deformable in some embodiments.

The layer body can be rolled up, for example. This, for example, being in the manner as carpets can be rolled up. The layer body can include, for example, several widths of a material that can be rolled up.

In a typical embodiment, the layer body is a body that is different than the one or the several encasings. The layer body then therefore does not form the one casing or the several encasings, and vice versa the one or several encasings then also does not form the layer body.

In some embodiments, the layer body has a thickness of less than 5 mm, in particular less than 3 mm.

In some embodiments, the connection leads are arranged below the layer body.

The connection leads can be laminated by the layer body. An improved optical impression of the ice rink can be achieved by way of this.

In some embodiments, the illuminants arrangement is arranged above the layer body.

In other embodiments, the illuminants arrangement is arranged below the layer body.

In some embodiments, the protective overlay is arranged above the layer body, whereas the one or more encasings are arranged below the layer body.

In some embodiments, the protective overly and/or the one or several encasings are at least partly arranged at the level of the layer body.

In some embodiments, the layer body has openings that include a light passage for light emitted by the light sources.

In some embodiments, the layer body includes openings for receiving at least parts of the illuminants arrangement.

The protective overlay can basically be optional in a special aspect of the invention.

The illumination device includes an illuminants arrangement described in the present patent application as well as a control unit for the control of the light sources. Thereby, the light sources are operationally connected to the control unit by way of the connection leads.

The control unit can include a voltage source for the light sources.

As already indicated, each of the light sources can be suitable for the emission of light of a variable colour, wherein the colour of each of the multitude of light sources can be individually (thus independently of the other light sources) selected by way of the control unit.

The control unit, for example, can be designed for the control of the multitude of light sources by way of a digital control protocol via the electrical connection leads. The possibility of the control via a bus is already described above.

The ice rink includes an illuminants arrangement of a type described in the present patent application, which is incorporated in this ice rink. It can also include an illumination device of a type described in the present patent application.

The illuminants arrangement can be frozen into the ice of the ice rink.

In particular, a playing field with playing field markings incorporated into the ice of the ice rink can be formed by the ice rink.

Thereby, one can envisage playing field markings being formed in the ice rink by way of the illuminants arrangement. It is even possible for further playing field markings as are formed, e.g., by way of felt strips frozen into the ice rink to become superfluous by way of the illuminants arrangement.

In one embodiment, the ice rink includes:

- a base ice layer (whose thickness typically lies between 5 mm and 15 mm, but can also be thicker, e.g. up to 50 mm or even up to 80 mm thick), which is deposited onto a ground;
- a colour-carrying, in particular white cover layer, which is placed on the base ice surface;
- a main ice layer, which is deposited on the cover layer and by way of which an ice surface of the ice rink is formed.

wherein the illuminants arrangement is incorporated into the main ice layer.

The ground itself is not formed by ice, but e.g. of concrete.

The thickness of the main ice layer typically lies between 15 mm and 45 mm, in particular between 20 mm and 40 mm.

Connection leads, by way of which the illuminants arrangement is operationally connected to an assigned control unit, can be led through below a boards arrangement of the ice rink.

A first method for incorporating an illuminants arrangement into an ice rink includes a groove being formed in the ice rink by way of a router (miller) and the illuminants arrangement being introduced into the groove. The groove is subsequently filled out, typically with water, which is subsequently frozen.

In particular, the groove can have a rectangular cross section.

A second method for incorporating an illuminants arrangement into an ice rink includes an ice rink inlay, to which the illuminants arrangement belongs, being incorporated into the ice rink. This is effected before an uppermost ice layer of the ice rink is formed. For example, the ice rink inlay can also be provided in the lowermost ice layer of the ice rink. The ice rink can include a (not consisting of ice) ground (e.g. of concrete), and the ice rink inlay can be laid thereon (before or after water for the lowermost ice layer of the ice rink is admitted), and the water for the lowermost ice layer of the ice rink is then frozen, so that the ice rink inlay (at least partly) is frozen into the lowermost ice layer of the ice rink.

The ice rink inlay can form part of an ice layer, e.g. a base ice layer, of the ice rink.

A relative positioning of the light sources of the illuminants arrangement to one another as well as possibly also a positioning of the light sources of the illuminants arrangement within an ice rink, into which the ice rink inlay is incorporated, can be fixed by way of fastening the illuminants arrangement on the layer body.

The ice rink inlay can be created prior to the incorporation of the illuminants arrangement into an ice rink, wherein, for example, the illuminants arrangement is fastened on the layer body, and the ice rink inlay can subsequently be introduced into the ice rink, e.g. by way of rolling out a layer body that can be rolled up, or by way of folding out plates of the layer body that are fastened to one another or by way of joining, e.g. sticking together (previously separate) plates of the layer body.

The invention also relates to a use of one of illuminants arrangement or illumination device or ice rink inlay that are described in the present application, for illuminating an ice rink from the inside of the ice of the ice rink, in particular for displaying playing field markings and/or for the surfaced representation of pictures, in particular also moving pictures.

Further embodiments and advantages are to be deduced from the patent claims and from the figures.

BRIEF DESCRIPTION OF THE DRAWINGS

The subject-matter of the invention is hereinafter explained in more detail by way of embodiment examples and the attached drawings. In each case are shown schematically in.

DETAILED DESCRIPTION OF THE INVENTION

Parts which are not essential to the understanding of the invention are not represented to some extent. The described embodiment examples represent the subject-matter of the invention by way of example or they serve for its explanation and have no limiting effect A section through the illuminants arrangement 1 is represented schematically in FIG. 1. The illuminants arrangement 1 can be embodied for example in a strip-shaped manner with a multitude of light sources, wherein the respective strip runs perpendicular to the plane of the drawings.

Figure 1:
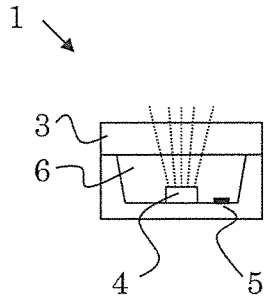
FIG. 1 a section through an illuminants arrangement.

What is represented in FIG. 1 are: a light source 4, a connection lead 5, a water-tight encasing 6, a housing part 6', which can contribute to the encasing of the light source 4, and a protective overlay 3.

The light source 4 is controllable and/or can be supplied with electrical voltage via a connection lead 5.

The light source can, e.g., include a red-illuminating, a green-illuminating and a blue-illuminating LED, and possibly additionally yet a white light LED.

The protective overlay 3, for example, can be a plate or a strip of polycarbonate. It protects that lies below from mechanical damage, as can be caused, for example, by way of an ice skate.

Figure 2:
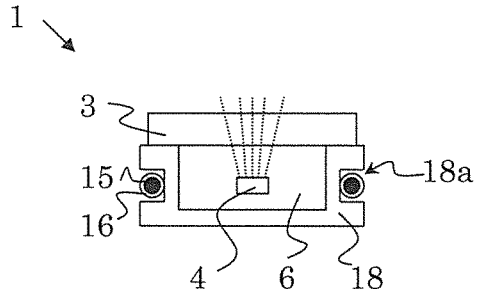
FIG. 2 a section through an illuminants arrangement with a heating device.

A section through an illuminants arrangement 1 with a heating device is represented schematically in FIG. 2. The heating device includes two heating wires 15, which are electrically insulated by an insulation 16 and which produce heat when an adequately high electrical current flows through them.

The heating wires 15 are received in grooves 18*a* of a rail 18, the rail being manufactured, for example, of aluminium and being arranged outside the encasing 6, so that it surrounds the light source 4 at three sides (at the bottom and laterally).

Heat produced by way of the heating wires 15 is distributed by way of the rail 18, so that a melting of ice, into which the illuminants arrangement 1 is incorporated (frozen) is possible, which greatly simplifies a removal of the illuminants arrangement.

Such a rail 18 and heating wires 15 can be combined with arbitrary illuminants, for example with that represented in FIG. 1.

Figure 3:
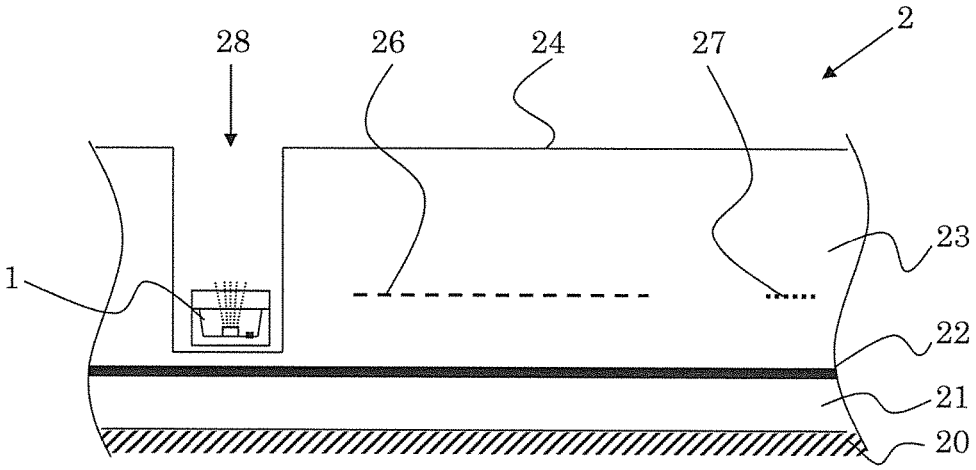
FIG. 3 a section through an ice rink.

FIG. 3 in a greatly schematic manner shows a section through the ice rink 2. A base ice layer 21 is deposited on a ground 20, e.g. of concrete, on which base ice layer in turn a cover layer 22 of a white colour is placed. A main ice layer 23, which also forms the ice surface 24 of the ice rink 2, is present above this.

Advertising banners 26 (symbolised in a dashed manner) as well as playing field markings 27 (symbolised in a dotted manner), which typically consist of a coloured felt, are incorporated into the ice, typically approximately 10 mm above the cover layer 22.

The advertising banners 26 as well as the playing field markings 27 can be replaced by illuminants arrangements 1, as is represented e.g. in FIGS. 1, 2, or by way of suitable illumination devices.

A groove 28 with a rectangular cross section can be formed in the ice down to a depth, for example, of 1 mm to 2 mm above the cover layer 22, for incorporation into the ice of the ice rink 2. An illuminants arrangement 1 can then be brought into the groove 28. This is particularly suitable for illuminants arrangements with strip-shaped units, be they straight or arcuate or elastically deformable.

Electrical connection leads can be led through below a boards of the ice rink (not represented).

The groove 28 can then be filled with water, which then freezes.

Figure 4:
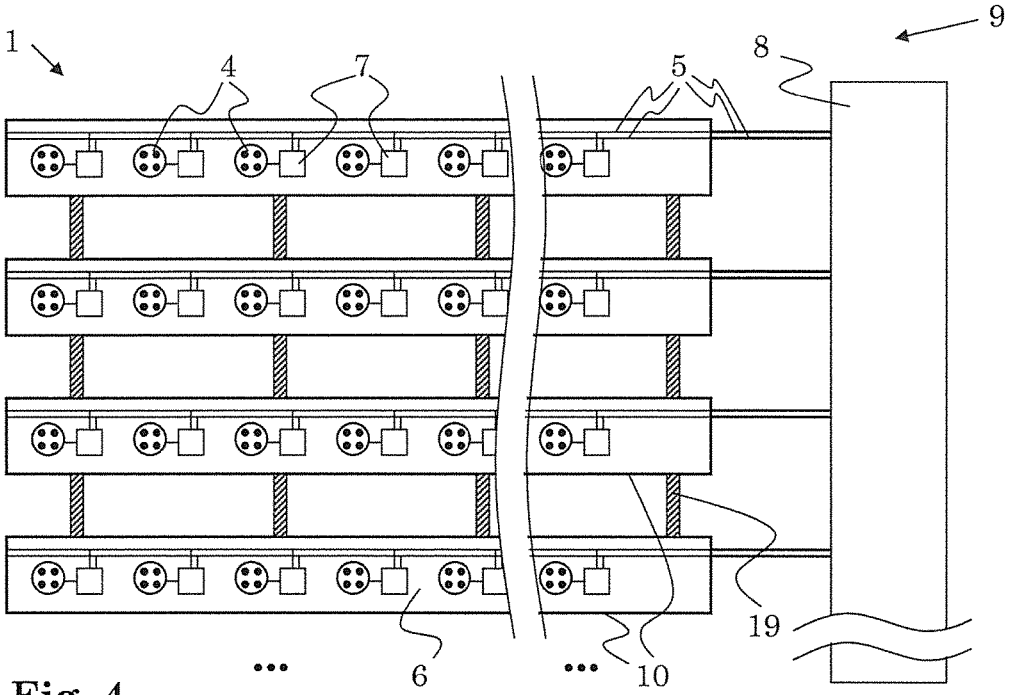
FIG. 4 a plan view onto an illumination device with light sources arranged distributed over a surface.

FIG. 4 schematically shows a plan view of an illumination device 9 with light sources arranged in a manner distributed over a surface. The illumination device 9 apart from an illuminants arrangement 1 yet includes a control unit 8, by way of which each of the light sources 4 can be individually activated. The colour and brightness of each light source 4 of the illuminants arrangement 1 can thus be individually set. E.g., each of the light sources includes four LEDs (RGBW).

A DMX control (digital multiplex) e.g. can be used for this, e.g. DMX512 as is known from illumination technology, or also a control according to a DALI standard (digital addressable lighting interface) or according to a KMX standard.

The connection leads 5, by way of which the digital control commands can be transmitted to the light sources 4 (or more precisely, firstly to the respective electrical circuits 7) via a bus, are also schematically represented in FIG. 4.

The light sources 4 in FIG. 4 are arranged on grid points of a right-angled grid. Several dozen or several hundred or even more light sources 4 can be arranged in both directions of the surface, so that infinite, also moved colour pictures can be represented.

Figure 5:
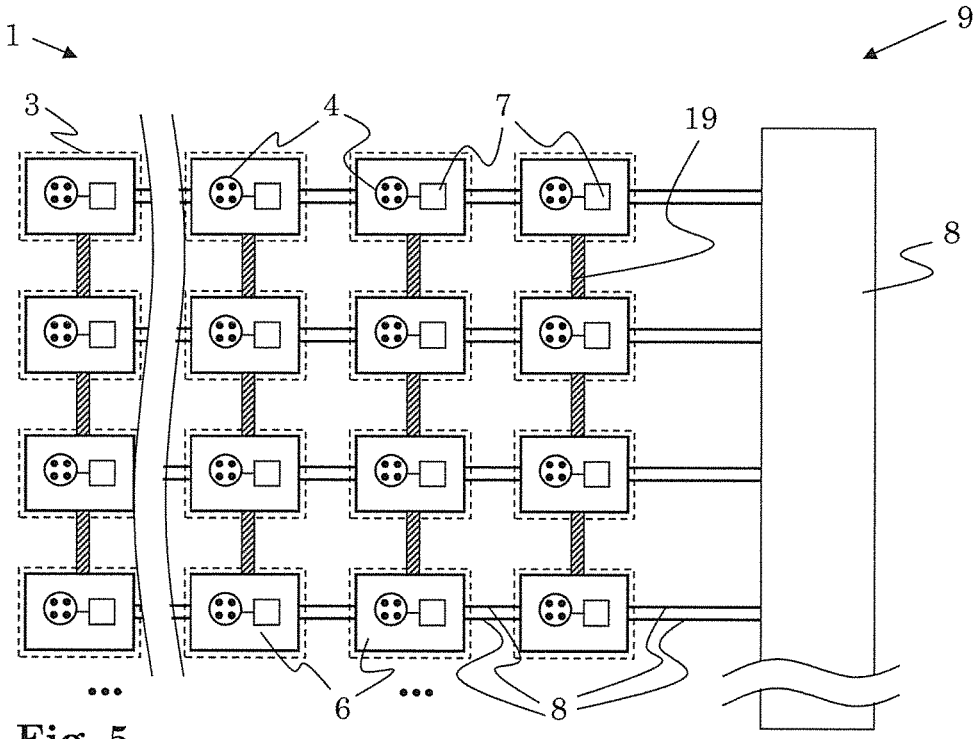
FIG. 5 a plan view onto an illumination device with light sources arranged distributed over a surface.

In the same manner as FIG. 4, FIG. 5 shows a schematic plan view of an illumination device 9 with light sources 4 which are arranged distributed over a surface, wherein the illumination device 9 of FIG. 5 with regard to function can be very similar to that of FIG. 4.

The illuminants arrangement 1 of FIG. 4, however, includes several strip-shaped units 10 that run parallel to one another and are connected to one another by way of mechanical connecting elements 19, e.g. of polymer, so that a suitable degree of accuracy of the mutual positioning of the light sources and also a suitable degree of mechanical stability of the illumination device 9 are ensured, which simplifies an introduction of the illuminants arrangement into an ice rink.

In contrast, in the case of the illuminants arrangement 1 of FIG. 5, the light sources 4 (and the associated circuits 7) are each individually (separately) potted (encased), so that—in contrast to the case of FIG. 4—the encasing 6 cannot contribute to the mechanical stability and positioning stability of the illuminants arrangement 1 of FIG. 5 to a sufficient extent. For this reason, the electrical connection leads 5, e.g., can simultaneously also serve as mechanically stabilising connecting elements. Or additional connecting elements are provided (not represented in FIG. 5).

An illuminants arrangement, e.g. one of the previously described ones, together with a layer body, on which it is fastened, can form an ice rink inlay. The ice rink inlay on the one hand can simplify the introduction of the illuminants arrangement into an ice rink and on the other hand form a—typically—white cover layer of the ice rink.

The layer body can be of felt for example, which, e.g., is white at least on one side, or of a foil, which is provided with holes (for water permeability) and which, e.g., is white at least on one side, or of another water-permeable, layer-like material that is self-supporting. The layer body can include several sections, which can be joined onto one another, in order to be able to provide a large ice rink surface with the ice rink inlay in a simple manner by way of several (smaller) sections.

Figure 6:
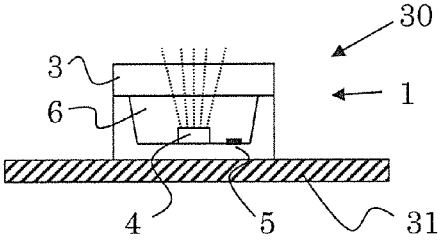
FIG. 6 a section through an ice rink inlay, with a layer body arranged below the illuminants arrangement.

FIG. 6 schematically shows a section through an ice rink inlay 30 with a layer body 31 arranged below the illuminants arrangement 1. The illuminants arrangement 1 as represented can correspond, for example, to that of FIG. 1.

Figure 7:
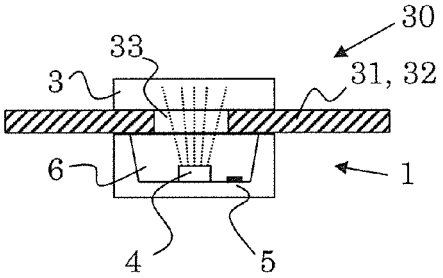
FIG. 7 a section through an ice rink inlay, with a layered body arranged between the encasing and protective overlay.

FIG. 7 schematically shows a section through an ice rink inlay 30 with a layer body 31 arranged between the encasing 6 and the protective overlay 3. The layer body 31 includes a non-transparent region 32 as well as at least one transparent region 33 for the passage of light of the light sources 4. Connection leads 5 and other constituents of the illuminants arrangement that could compromise the optical impression of the ice rink provided with the ice rink inlay 30 (e.g., because they are not white and/or could cast shadows) are covered by the non-transparent region 32.

Figure 8:
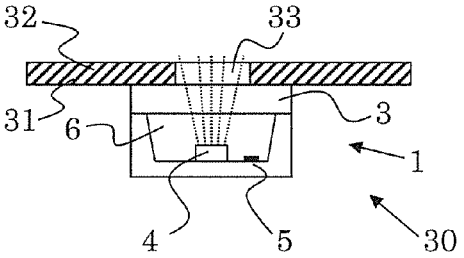
FIG. 8 a section through an ice rink inlay, with a layered body arranged above the illuminants arrangement.

FIG. 8 schematically shows a section through an ice rink inlay 30 with a layer body 31 arranged above the illuminants arrangement. A layer body 31 provided with a non-transparent region 32 and transparent regions 33 can also be applied here, as in FIG. 7.

Moreover, it is also possible (not represented) to provide an ice rink inlay with a layer body including openings for receiving the illuminants arrangement. For example, parts of the illuminants arrangement at its respective sides can be adjacent to the boundaries of the openings and for example also be connected to the layer body there.

Figure 9:
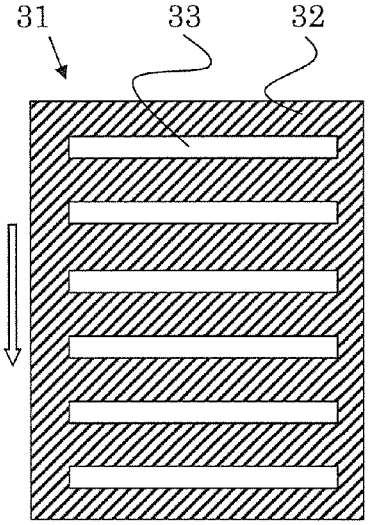
FIG. 9 a plan view onto a layer body.

FIG. 9 schematically shows a plan view of a layer body 31, which includes a non-transparent region 32 as well as several transparent regions 33, which are strip-shaped in the represented example. In one variant, the transparent regions 33 can be openings, in which (for example) strip-shaped constituents of an illuminants arrangement can be incorporated.

The layer body 31 can e.g. be rolled up, for example along the direction indicated by the open arrow in FIG. 9.

Figure 10:
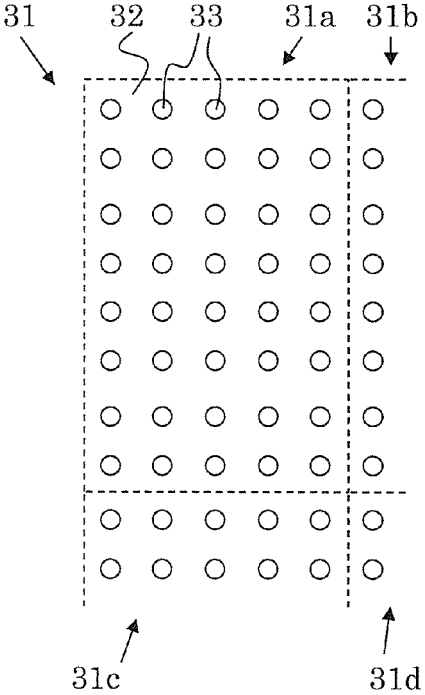
FIG. 10 a plan view onto a layer body with several sections.

FIG. 10 schematically shows a plan view onto a layer body 31 with several sections 31*a*, 31*b*, 31*c*, 31*d* . . . . Each of the sections 31*a*, 31*b*, 31*c*, 31*d* . . . includes several transparent regions 33, which, for example, can be round as is represented, as well as a non-transparent region 32. A transparent region 33 can be assigned, for example, to each light source.

In an embodiment, the sections 31*a*, 31*b*, 31*c*, 31*d* . . . can each be plates that are shape-stable and stackable, and can be joined together for forming the layer body or the ice rink inlay.

Similarly, that which is represented in FIG. 9, in a variant can also be a single section of a layer body.

Figure 11:
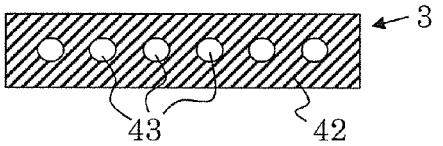
FIG. 11 a plan view onto a protective overlay with transparent regions and with a non-transparent region.

FIG. 11 schematically shows a view onto a protective overlay 3 with transparent regions 43 and a non-transparent region 42. Some optically annoying constituents of the illuminants arrangement can be covered by way of this.

E.g., a transparent region 43 can be assigned to each light source.

And/or a light source can be assigned to each transparent region 43.

In some embodiments, it is possible to provide positioning aids such as pins, for example, by way of which an (accurate) positioning of a protective overlay 3 (with transparent regions and a non-transparent region, e.g. as represented in FIG. 11) relative to the light sources can be achieved. An (exact) positioning of non-transparent regions of the layer body relative to the light sources can become superfluous on account of this (e.g., in structures as in FIGS. 7 and 8), which can simplify the creation of the respective ice rink inlay.

As already mentioned and according to a special aspect of the invention, an illuminants arrangement without a protective overlay can be provided. Accordingly, according to this special aspect, the protective overlay in the ice rink inlay can be optimal, and thus possibly not be present, even if it is represented e.g. in the FIGS. 6 to 8.

The features mentioned above can be advantageous together or also individually or in arbitrary combination.

The invention claimed is:

1. An ice rink inlay, comprising an illuminants arrangement and a layer body for forming a cover layer of an ice rink, wherein the illuminants arrangement is fastened to the layer body, and wherein the illuminants arrangement comprises a plurality of LED-based light sources that are encased in a water-tight manner by way of one or more encasings, wherein the light sources are, at least in a group-wise manner, operationally interconnected by way of electrical connection leads, wherein the connection leads comprise voltage supply leads.

2. The ice rink inlay according to claim 1, wherein the layer body comprises several sections that are joined together to form the layer body.

3. The ice rink inlay according to claim 1, wherein the layer body comprises several shape-stable plates that are movable relative to one another.

4. The ice rink inlay according to claim 3, wherein the plates can be folded onto one another.

5. The ice rink inlay according to claim 3, wherein the shape-stable plates can be joined together.

6. The ice rink inlay according to claim 1, wherein the layer body can be rolled up.

7. The ice rink inlay according to claim 1, wherein the layer body comprises several widths of a material which can be rolled up.

8. The ice rink inlay according to claim 1, wherein the layer body is water-permeable.

9. The ice rink inlay according to claim 1, wherein the layer body is water-permeable due to its material characteristics.

10. The ice rink inlay according to claim 1, wherein the layer body is water permeable due to a plurality of holes that extend through the layer body.

11. The ice rink inlay according to claim 1, wherein the layer body comprises a foil that is perforated.

12. The ice rink inlay according to claim 1, wherein the layer body is fibrous.

13. The ice rink inlay according to claim 1, wherein the layer body comprises a felt.

14. The ice rink inlay according to claim 1, wherein the layer body comprises a woven material.

15. The ice rink inlay according to claim 1, wherein the layer body comprises a porous material.

16. The ice rink inlay according to claim 1, wherein the layer body comprises a non-transparent region and at least one transparent region.

17. The ice rink inlay according to claim 16, wherein the at least one transparent region permits passage of light emitted from the light sources.

18. The ice rink inlay according to claim 17, wherein the at least one transparent region is an opening.

19. The ice rink inlay according to claim 16, wherein the layer body comprises several transparent regions, wherein each of the several transparent region is assigned to a different one of the light sources.

20. The ice rink inlay according to claim 19, wherein each of the transparent regions is an opening.

21. The ice rink inlay according to claim 1, wherein the layer body is arranged above the illuminants arrangement.

22. The ice rink inlay according to claim 1, wherein the layer body comprises openings for receiving the illuminants arrangement, such that parts of the illuminants arrangement are adjacent to boundaries of the openings.

23. The ice rink inlay according to claim 1, wherein the layer body is self-supporting.

24. The ice rink inlay according to claim 1, wherein the illuminants arrangement comprises, as a protection of the one or more encasings and of the light sources from mechanical damage, at least one protective overlay for being brought onto the one or more encasings, so that light emitted by the light sources can be emitted through the at least one protective overlay.

25. The ice rink inlay according to claim 1, wherein the layer body has a white surface and forms, at least section-wise, a white cover layer of an ice rink.

26. The ice rink inlay according to claim 1, wherein the illuminants arrangement comprises, in addition to the light sources, a heating device for producing heat.

27. An ice rink comprising an ice rink inlay according to claim 1, which is incorporated therein, and wherein playing field markings are formed in the ice rink by way of the illuminants arrangement.

28. A method for incorporating an illuminants arrangement into an ice rink, wherein an ice rink inlay according to claim 1 is incorporated into the ice rink before an uppermost ice layer of the ice rink is formed.

29. The method according to claim 28, wherein the ice rink comprises a ground and wherein the ice rink inlay is placed onto the ground, and a water layer surrounding the ice rink inlay is subsequently frozen.

* * * * *